US008851657B2

(12) United States Patent
Shiba

(10) Patent No.: US 8,851,657 B2
(45) Date of Patent: Oct. 7, 2014

(54) HYBRID INK JET PRINTER AND METHOD OF HYBRID INK JET PRINTING

(71) Applicant: Kabushiki Kaisha Tokyo Kikai Seisakusho, Tokyo (JP)

(72) Inventor: Noriyuki Shiba, Tokyo (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 74 days.

(21) Appl. No.: 13/674,569

(22) Filed: Nov. 12, 2012

(65) Prior Publication Data

US 2013/0249977 A1 Sep. 26, 2013

(30) Foreign Application Priority Data

Mar. 26, 2012 (JP) ..... 2012-070372

(51) Int. Cl.

| | |
|---|---|
| ***B41J 2/01*** | (2006.01) |
| ***B41J 29/38*** | (2006.01) |
| ***B41J 2/135*** | (2006.01) |
| ***B41J 2/145*** | (2006.01) |
| ***B41J 3/54*** | (2006.01) |
| ***B41J 11/00*** | (2006.01) |
| ***B41J 15/04*** | (2006.01) |
| ***B41J 3/60*** | (2006.01) |

(52) U.S. Cl.

CPC *B41J 2/145* (2013.01); *B41J 3/543* (2013.01); *B41J 11/002* (2013.01); *B41J 15/04* (2013.01); *B41J 3/60* (2013.01)

USPC ..... 347/102; 347/6; 347/44

(58) Field of Classification Search

CPC ..... B41J 11/002; B41J 11/0015; B41J 2/145; B41J 3/60

USPC ..... 347/6, 101, 102, 104, 44

See application file for complete search history.

(56) References Cited

U.S. PATENT DOCUMENTS

| | | | | |
|---|---|---|---|---|
| 5,371,531 | A | 12/1994 | Rezanka et al. | |
| 2010/0225936 | A1* | 9/2010 | Young | 358/1.9 |
| 2011/0128319 | A1* | 6/2011 | Mitsuzawa | 347/102 |
| 2011/0128338 | A1 | 6/2011 | DeCook et al. | |

FOREIGN PATENT DOCUMENTS

| | | |
|---|---|---|
| JP | 2004-351757 | 12/2004 |
| JP | 2009-226863 | 10/2009 |

* cited by examiner

*Primary Examiner* — Jannelle M Lebron

(74) *Attorney, Agent, or Firm* — Clark Hill PLC

(57) ABSTRACT

This hybrid ink get printer HIP includes; a print medium supply unit MS for supplying a print medium W; and a printing unit 4 for printing on the print medium W, the printing unit 4 comprising at least two print head units each configured from a print head that discharges ink, and a drying format differing between ink discharged by one of the print head units and ink discharged by another of the print head units.

8 Claims, 7 Drawing Sheets

HYBRID INK JET PRINTER AND METHOD OF HYBRID INK JET PRINTING

CROSS-REFERENCE TO RELATED APPLICATIONS

The present application relates to subject matter contained in Japanese Patent Application No 2012-070372, filed on Mar. 26, 2012, all of which is expressly incorporated herein by reference in its entirety.

BACKGROUND OF THE INVENTION

1. Field of the Invention

The present invention relates to a hybrid ink jet printer for printing by discharging ink to a print medium such as a continuous paper by means of an ink jet head, and a method of hybrid ink jet printing, specifically; to a hybrid ink jet printer configured capable of discharging different kinds of inks by a plurality of printing units, and a method of printing in the hybrid ink jet printer so configured.

2. Description of the Related Art

In conventional publicly known offset printing, printing can be performed not only using ordinary ink (for exampling, newspaper ink), but also using ultraviolet curable ink.

This ultraviolet curable ink instantaneously cures and dries when irradiated with ultraviolet light. In addition, the ultraviolet curable ink displays strong film strength from immediately after transfer, hence does not require a waiting time until post-processing. Therefore, a printer that prints using ultraviolet curable ink can print also on print media such as coated paper that has undergone surface processing and is difficult for the ink to penetrate, films, or the like. That is, if printing is performed using ultraviolet curable ink, printing can be performed on a wide variety of print media.

Meanwhile, an ink jet printer is proposed as a different method of printing to an offset rotary press (refer to Patent Document 1 listed below). Two kinds of printing systems of the ink jet printer exist, namely a single-pass system that, when a print medium passes below four colors' worth of inkjet heads (an inkjet head group) aligned in a print medium running direction and each having a length capable of single color printing of an entire paper width, prints all of the colors concurrently, and a multi-pass system that, while an ink jet head travels back and forth multiple times in a paper width direction over a print medium, sprays ink onto the print medium. The single-pass system has a feature that increased printing speed can be realized, while the multi-pass system has a feature that precise printing can be realized.

Incidentally, in order to configure a printer capable of handling a wide variety of print media, ultraviolet curable ink should be employed as mentioned above, but ultraviolet curable ink suffered the problem of being expensive compared to ordinary ink and of incurring high running costs. Therefore, it was desired that, when the print medium could sufficiently handle ordinary ink, printing could be performed by cheap price ordinary ink, and that, when good printing could not be realized by ordinary ink as in the case of coating paper, printing could be performed by ultraviolet curable ink.

Accordingly, as shown in FIG. 6, a method was proposed that installs a total of two off set rotary presses, that is, one each of, respectively, an offset rotary press 70 that prints using ordinary ink and an offset rotary press 80 that prints using ultraviolet curable ink, and thereby selectively uses the inks to enable handling of a wide variety of print media. If two offset rotary presses 70 and 80 are installed in this way, when a paper roll is set in the print paper feed unit, selection can be made of the offset rotary press 70 that prints using ordinary ink or the offset rotary press 80 that prints using ultraviolet curable ink, thus enabling handling of a wide variety of print media. However, a method where two offset rotary presses are installed requires securing of a large installation space, and therefore cannot be realized, in a place having no space. Accordingly, a printer was desired that was capable of handling a wide variety of print media while still being compact.

In contrast, a method of printing is proposed that suppresses running costs by switching the inks used. That is, a method of printing was proposed in which, when printing on a print medium where good printing can be realized by ordinary ink, ordinary ink is set as the ink supplied, and when printing on a print medium where good printing cannot be realized by ordinary ink, ultraviolet curable ink is set as the ink supplied.

However, the method of printing that switches the ink supplied from an ink supply device to match the print medium had the problem that trouble occurs in a group of ink transfer rollers, or a plate cylinder and blanket, and so on, that are traversed when transferring the ink. As shown in FIG. 7, printing by an offset rotary press is performed by ultraviolet curable ink being supplied from an ink fountain 91, the supplied ultraviolet curable ink traversing a group of ink transfer rollers 92 to be shifted to a plate cylinder 93, and further to be shifted from the plate cylinder 93 to a blanket cylinder 94, after which the ultraviolet curable ink is transferred from the blanket cylinder 94 to continuous paper. That is, the ultraviolet curable ink passes the same route as the route along which ordinary ink moves, hence traverses the same group of ink transfer rollers 92, plate cylinder 93, and blanket cylinder 94 as the group of ink transfer rollers 92, plate cylinder 93, and blanket cylinder 94 that are traversed by ordinary ink when ordinary ink is employed.

The group of ink transfer rollers 92, or a plate (not illustrated) on the plate cylinder 93 and a blanket (not illustrated) on the blanket cylinder 94, and so on, although never causing trouble simply when constituents of ordinary ink adhere, do cause trouble when ultraviolet curable ink adheres. Specifically, low molecular constituents of high polarity included in ultraviolet curable ink cause swelling of the group of ink transfer rollers 92 and rubber of the blanket on the blanket cylinder 94 for use in ordinary newspaper printing, and also dissolve resin forming a picture line part of the plate on the plate cylinder 93 for use in ordinary newspaper printing.

In order to prevent these troubles, an ultraviolet curable ink is proposed (for example, Daicure Hy-Bryte) that has high lipophilicity of the ink and has aptitude for the plate cylinder, group of ink transfer rollers and blanket of a printer for use in ordinary newspaper printing. The provision of such an ultraviolet curable ink has made it possible to realize selective use of inks simply by switching the ink supplied from the ink fountain without performing large maintenance work such as replacement of the group of ink transfer rollers 92 or replacement of the plate on the plate cylinder 93, and so on ( refer to Patent Document 2 listed below).

[Patent Document 1] JP 2009-226863 A

[Patent Document 2] JP 2004-351757 A

SUMMARY OF THE INVENTION

However, in the technology described in the above-listed Patent Document 2, although printing can be performed without replacing a cleaning agent or plate material and so on by dedicated ones, cleaning of the group of ink transfer rollers 92 must be performed when the ink is changed, hence maintenance work was still required. As is clear from the above, up to now, a printer that requires no maintenance work, is of compact shape, and is capable of handling a wide variety of print media, did not exist.

On the other hand, in an ink jet printer, a group of ink transfer rollers or a plate and so on do not exist, hence even if the ink is switched, these maintenance works are not required. Furthermore, since the group of ink transfer rollers or plate and so on do not exist, the ink jet printer has a compact shape. However, a conventional ink jet printer as represented in the above-listed Patent Document 1 is assumed to employ inks having identical characteristics, and, up to now, the technical concept of installing inks of different characteristics in one ink jet printer and printing by combining the inks of different characteristics, did not exist.

The present invention was made in view of the above problems of the conventional technology, and an object of the present invention is to provide a hybrid ink jet printer requiring no large maintenance work and capable of being applied to a large variety of print media, and a method of hybrid ink jet printing, and to provide a hybrid ink jet printer allowing an installation area to be suppressed and capable of being applied to a large variety of print media without incurring great cost, and a method of hybrid ink jet printing.

A hybrid ink jet printer according to the present invention includes: a print medium supply unit for supplying a continuously linked print medium; and a printing unit for printing on the print medium, the printing unit comprising at least two print head units each configured from a print head that discharges ink, and a drying format differing between ink discharged by one of the print head units and ink discharged by another of the print head units.

The hybrid ink jet printer according to the present invention may be configured such that the printing unit comprises at least a first printing unit and a second printing unit, the first printing unit comprising the one of the print head units, and the second printing unit comprising the other of the print head units, and the first printing unit and the second printing unit are disposed adjacently and are capable of delivering the print medium between first and second printing units.

Moreover, the hybrid ink jet printer according to the present invention may be configured comprising: a control device for providing an instruction that causes either of the first printing unit and the second printing unit to perform printing, and such that printing is performed using only either the first printing unit or the second printing unit.

Moreover, the hybrid ink jet printer according to the present invent ion may be configured comprising: a control device for providing an instruction that causes each of the first printing unit and the second printing unit to perform printing, and such that printing is performed using each of a plurality of the first printing unit and the second printing unit.

Moreover, the hybrid ink jet printer according to the present invention may be configured such that performing printing on the print medium by the first printing unit and then performing further printing on the print medium by the second printing unit enables one printed matter printed by inks of different drying formats to be produced.

Moreover, the hybrid ink jet printer according to the present invention may be configured such that the print head includes at least a print head that discharges ultraviolet curable ink.

Furthermore, the hybrid ink jet printer according to the present invention may be configured such that the first printing unit and the second printing unit are disposed in series.

Furthermore, the hybrid ink jet printer according to the present invention may be configured such that the first printing unit and the second printing unit are disposed in parallel.

A method of hybrid ink jet printing according to the present invention, executed using a hybrid ink jet printer, the hybrid ink jet printer including: a print medium supply unit for supplying a continuously linked print medium; and a printing unit for printing on the print medium, the printing unit comprising at least two print head units each configured from a print head that discharges ink, comprises: printing being executed by causing a drying format to differ between ink discharged by one of the print head units and ink discharged by another of the print head units.

The present invention enables provision of a hybrid ink jet printer requiring no large maintenance work and capable of being applied to a large variety of print media, and a method of hybrid ink jet printing. Moreover, the present invention enables provision of a hybrid ink jet printer allowing an installation area to be suppressed and capable of being applied to a large variety of print media without incurring great cost, and a method of hybrid ink jet printing.

DETAILED DESCRIPTION OF THE INVENTION

Preferred embodiments for carrying out the present invention are described below with reference to the drawings. The following embodiments are not intended to limit the inventions set forth in the claims, and the combinations of features described in the embodiments are not all necessarily indispensable for the in means for solving the problem provided by the invention.

[First Embodiment]

Figure 1:
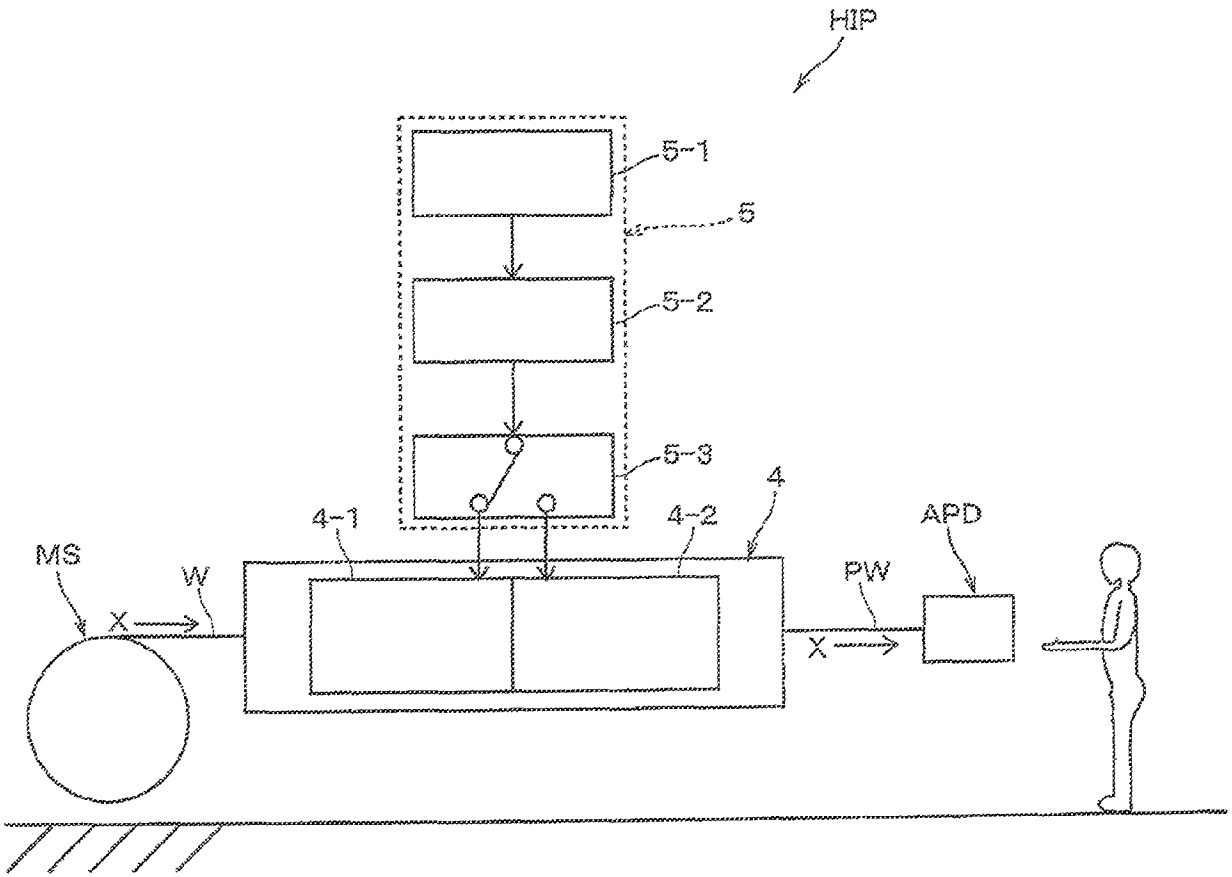
FIG. 1 is a schematic view showing an overall configuration of a hybrid ink jet printer according to a first embodiment.
Figure 2:
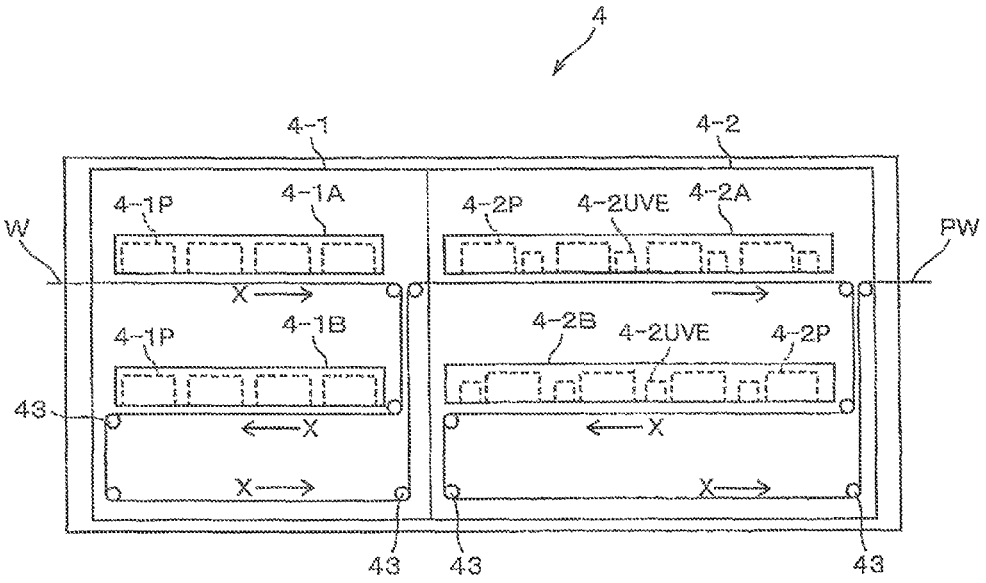
FIG. 2 is a schematic view showing an internal structure of a printing unit included in the hybrid ink jet printer shown in FIG. 1.

FIG. 1 is a schematic view showing an overall configuration of a hybrid ink jet printer according to a first embodiment. In addition, FIG. 2 is a schematic view showing an internal structure of a printing unit included in the hybrid ink jet printer shown in FIG. 1. Note that in FIGS. 1 and 2, the symbol X indicates a running direction of the print medium. Moreover, the human figure shown in FIG. 1 is depicted to give a rough guide of device scale.

A hybrid ink jet printer HIP according to the first embodiment comprises a print medium supply unit MS for supplying a continuous paper W. Installed on a downstream side of the print, medium supply unit MS are: a printing unit 4 for printing on the continuous paper W; a control unit 5 for performing overall control of the hybrid ink jet printer HIP, input of settings or transmission/receipt, and so on, of printing information; and a post-processing unit APD for performing post-processing such as cutting or folding of a (post-printing) continuous paper PW that has undergone printing.

The print medium supply unit MS suspends a paper web, and supplies the continuous paper W toward the printing unit 4 which is on the downstream side from the print medium supply unit MS. In the first embodiment, there is a configuration adopting a paper medium like the continuous paper W as the print medium, but there may also be a configuration adopting a resin medium such as an elongated resin film as the print medium. When an elongated resin film is adopted as the print medium, a delivery device (winding-out device) for supplying the film to the printing unit 4 need only be provided.

The printing unit 4 according to the first embodiment prints on the continuous paper W sent forth from the print medium supply unit 4 by means of, for example, an in-feed unit-like rotationally-driven in-feed roller (not illustrated) and a pressing roller (not illustrated) to press the continuous paper W wound onto the in-feed roller onto a peripheral surface of the in-feed roller.

FIG. 2 is a schematic view showing an internal structure of the printing unit 4 included in the hybrid ink jet printer HIP according to the first embodiment.

The printing unit 4 according to the first embodiment comprises two different kinds of printing units, namely, a first printing unit 4-1 and a second printing unit 4-2. Installed in the first printing unit 4-1 are two print head units 4-1A and 4-1B comprising print heads 4-1P discharging ink, and installed respectively in these two print head units 4-1A and 4-1B are four each of the print heads 4-1P. In the print head units 4-1A and 4-1B installed in the first printing unit 4-1, an ink other than ultraviolet curable ink (hereafter referred to as "ordinary ink") is employed, and printing on the continuous paper W is executed by this ordinary ink being discharged from the print head 4-1P onto the continuous paper W and fixing to the continuous paper W.

On the other hand, installed in the second printing unit 4-2 are two print head units 4-2A and 4-2B comprising print heads 4-2P discharging ink, and installed respectively in these two print head units 4-2A and 4-2B are four each of the print heads 4-2P. Moreover, installed on a downstream side of the plurality of print heads 4-2P so as to correspond to each of the print heads 4-2P are ultraviolet exposure units 4-2UVE. In addition, in the print head units 4-2A and 4-2B installed in the second printing unit 4-2, ultraviolet curable ink is employed, and, as a result of this ultraviolet curable ink being discharged from, the print head 4-2P onto the continuous paper W and then immediately receiving ultraviolet from the ultraviolet exposure unit 4-2UVE, the ultraviolet curable ink attached to a surface of the continuous paper W solidifies to become firmly fixed, whereby printing on the continuous paper W is executed.

Furthermore, the first printing unit 4-1 and the second printing unit 4-2 are disposed adjacent and in series. As shown in FIG. 2, delivery of the continuous paper W between the first printing unit 4-1 and the second printing unit 4-2 is realized by guide rollers 43, and so on, installed in each of the printing units 4-1 and 4-2. This results in the print medium passing through both of the first printing unit 4-1 and the second printing unit 4-2, thereby making it possible to select which of the printing units is to be used to print.

The guide rollers 43 are disposed such that discharge of ink by the print head units 4-1A, 4-1B, 4-2A, and 4-2B is performed from a direction substantially vertically above the continuous paper W. Hence, discharge of ink by the print heads 4-1P and 4-2P can be performed without running counter to gravity, thereby enabling high precision printing in either of the first printing unit 4-1 and the second printing unit 4-2.

The print heads 4-1P and 4-2P have four colors worth of print head groups provided, namely, a cyan ink-dedicated print head group, a magenta ink-dedicated print head group, a yellow ink-dedicated print, head group, and a black ink-dedicated print head group. Each of the print, head groups has a length capable of single color printing of the entire paper width and configures the print, heads 4-1P and 4-2P disposed respectively in a staggered state in a paper width direction. Note that the number of print head groups is not limited to four, and disposition of the print head groups is not limited to the staggered state either.

Next, ink supplied to the print heads is described. Inks can be classified from various standpoints, such as drying format, constituent material, or print quality when fixed to the print medium. For example, focusing on drying format of inks, examples of inks include: "evaporative drying format" ink, typified by the likes of "gravure ink", where a low boiling point solution in the ink evaporating at room temperature causes the ink to dry and become fixed; "penetrative drying format" ink, typified by the likes of "newspaper ink", where a low viscosity component in the ink penetrates inside the print medium and a dye is fixed in the fibers by a fixing component causing the ink to dry and become fixed; "oxidative polymerization format" ink, typified by the likes of "sheet plate ink", where dry oil undergoes oxidative polymerization by oxygen in the air causing the ink to dry and become fixed; "heat-induced evaporation format" ink, typified by the likes of "heat set ink", where heating causes a petroleum system solution in the ink to evaporate, thereby causing the ink to dry and become fixed; and "ultraviolet curable format" ink, typified by the likes of "ultraviolet curable ink", where monomers and so on polymerize by ultraviolet to form a solid coating. These inks each have a different drying format, hence nave merits and demerits in their compatibility with print media.

Explaining more specifically, for example, paper media of high penetrability such as paper for newspapers, ordinary paper, or the like, have good compatibility with inks of a drying format requiring the ink to penetrate into the print medium before the ink dries and becomes fixed. These paper media of high penetrability also have good compatibility with ultraviolet curable ink where the ink is caused to harden instantaneously by irradiating with ultraviolet without the need for penetrability. On the other hand, for example, coated paper (high quality paper subjected to surface processing), or films, and so on, have poor compatibility with inks of a drying format requiring the ink to penetrate into the print medium before the ink dries and becomes fixed. This is because it is difficult for ink to penetrate and become fixed in coated paper or films. Coated paper and films thus have good compatibility with ink of the "ultraviolet curable format" kind where the ink hardens instantaneously without penetrating.

In other words, ultraviolet curable ink is a functional ink capable of handling a wide variety of print media. Accordingly, all that is required is to print always using ultraviolet curable ink. However, there is a problem that the ink itself and an ultraviolet exposure lamp for drying the ink are expensive, hence continuing to always use ultraviolet curable ink leads to an increase in running costs. Therefore, it is desirable to be able to make selective use of inks, where a low-cost ink is used on ordinary paper or paper for newspapers, and ultraviolet curable ink is used on coated paper or films.

Accordingly, in the first embodiment, a drying format of ink discharged by the print head units 4-1A, 4-1B, 4-2A, and 4-2B is configured to differ in each of the printing units 4-1 and 4-2. Specifically, in the first embodiment where the first printing unit 4-1 and the second printing unit 4-2 are disposed in series with respect to the running direction X of the print medium and adjacent to one another, the first printing unit 4-1 on a forward side running direction is configured having the print head units 4-1A and 4-1B provided with ordinary ink, and the second printing unit 4-2 on a backward side running direction is configured having the print head units 4-2A and 4-2B provided with ultraviolet curable ink. Moreover, since a configuration is adopted where delivery of the continuous paper W can be performed between the first printing unit 4-1 and the second printing unit 4-2, expensive ink and low-cost ink can be selectively used according to the print medium, printing application, and so on, thus making it possible to reduce an economic burden.

In addition, when printing is being performed using only ink of the same drying format and the print medium is not suited to said ink, switching the ink enables a printing ink suited to the print medium to be employed. However, when switching the ink, drying equipment and so on must also be switched, whereby human burden involved in maintenance, mechanical damage, and so on, increases. Conventional printers have not included a mechanism capable of solving this kind of problem.

In contrast, in the hybrid ink jet printer according to the first embodiment, printing units 4-1 and 4-2 including inks compatible with at least two kinds of drying formats are provided, and appropriately employing these two kinds of printing units 4-1 and 4-2 by matching them to print media makes it possible to handle a large variety of print media. Therefore, even in the case where conventionally switching of inks is required, such switching of inks becomes unnecessary, thereby enabling a reduction in human burden involved in maintenance, mechanical damage due to stoppage of the printer, and soon.

Furthermore, the printing unit 4 according to the first embodiment is connected to the control unit 5. This control unit 5 is configured, from a JOB management device 5-1, a print head control device 5-2, and a printing unit selection device 5-3. As shown in FIG. 1, the JOB management device 5-1, the print, head control device 5-2, and the printing unit selection device 5-3 are connected to one another by wires to perform exchange of information.

The JOB management device 5-1 is capable of executing various kinds of functions, including: a transmitting/receiving function which is a function for transmitting/receiving various kinds of information, such as printing information employed in printing processed by gradation conversion and Raster Image Processing (RIP), imposition processing information employed in signature production, or printing unit selection information related to selection of the printing unit 4 employed in printing; a job operation function for setting number of copies printed or single/both side printing; a schedule management function for jobs where preparations for printing have been completed; a control function which is a function for control of the hybrid ink jet printer HIP; a display function which is a function for display of a state of printing; and so on.

As shown in FIG. 1, the print head control device 5-2 is configured to include one print head control device 5-2 with respect to the two printing units 4-1 and 4-2. In addition, the print head control device 5-2 is connected by wires to the JOB management device 5-1 and the printing unit selection device 5-3. Moreover, the print head control device 5-2 receives, from the JOB management device 5-1, printing information processed by gradation conversion and RIP. The print head control device 5-2, having performed conversion processing of the received printing information into discharge conditions command information related to discharge conditions of the inks, performs output to either of the print heads 4-1P or the print heads 4-2P selected by the printing unit selection device 5-3. This allows operation of either of the print heads 4-1P or the print heads 4-2P to be controlled.

The printing unit selection device 5-3 is connected by wires to the JOB management device 5-1 and the print head control device 5-2. The printing unit selection device 5-3 receives, from the JOB management device 5-1, information concerning which printing unit is to be used to perform the printing, and, based on the information received from the JOB management device 5-1, selects an output destination for the discharge conditions command information transmitted by the print head control device 5-2.

As described above, the printing unit selection device 5-3 selects the print heads based on information outputted to the printing unit selection device 5-3 by the JOB management device 5-1, and the print head control device 5-2 outputs discharge conditions command information to the print heads selected by the printing unit selection device 5-3. Moreover, this results in printing content displayed by ink discharged by the print heads 4-1P or the print heads 4-2P that have received the discharge conditions command information being appropriately displayed on the continuous paper W. By configuring in this way, since the hybrid ink jet printer HIP according to the first embodiment includes the following two printing units, namely, a printing unit capable of discharging an expensive ink (for example, ultraviolet curable ink) and a printing unit capable of discharging a low-cost ink (for example, a penetrative drying type ink), selective use of the expensive ink and the low-cost ink according to selection of the printing unit selection device 5-3 can be easily realized, thereby enabling a reduction in printing costs. Moreover, selective use of inks is enabled without large maintenance work.

The post-processing unit APD according to the first embodiment performs cutting processing to cut the continuous paper PW for which printing has been completed, or signature production processing to produce a signature using the print medium that has been formed into cut individual printed materials, and so on. In addition, when a resin medium such as an elongated resin film is adopted as the print medium, the post-processing unit APD may be configured to perform processing by a roll-to-roll system, rather than perform the cutting processing or signature production processing. The roll-to-roll system is a processing method that, by comprising a winding mechanism for winding a post-printing film in a roll state, enables continuous processing to be efficiently performed and productivity to be improved.

Next, operation of the hybrid ink jet printer HIP according to the first embodiment is described.

First, the paper web is suspended in the print medium supply unit MS, and operation starts by supplying the continuous paper W from the print medium supply unit MS. Then, the continuous paper W is sent forth to the printing unit 4 by, for example, the in-feed roller not illustrated. Now, operation is described employing the continuous paper W, but, for example, a resin medium such as an elongated resin film or the like may be employed, rather than a paper medium like the continuous paper W.

As the continuous paper W enters the printing unit 4, an optimal printing command in accordance with a kind of the continuous paper W is transmitted to the printing unit 4 by the control unit 5, whereby printing is executed. Now, in the printing unit 4 according to the first embodiment, the first printing unit 4-1 capable of printing by ordinary ink is installed on the front upstream side, and the second printing unit 4-2 capable of printing by ultraviolet curable ink is installed on the back downstream side, hence, by selecting either of the printing units, printing in accordance with the kind, properties, and so on, of the continuous paper W is made possible. For example, when printing is performed on a print medium of a paper quality having penetrability like ordinary paper and so on, the print heads 4-1P are selected as printing information output destinations of the print head control device 5-2. Moreover, for example, when printing is performed on a print medium of a paper quality suited to ultraviolet curable ink lacking penetrability such as coated paper or films and so on, the print heads 4-2P are selected as printing information output destinations of the print head control device 5-2. It is therefore possible to print continuously on a wide variety of print media without modifying the print head units 4-1A, 4-1B, 4-2A, and 4-2B of the printing unit 4.

That concludes description of a specific configuration and a method of operation of the hybrid ink jet printer HIP according to the first embodiment. That is, the hybrid ink jet printer HIP according to the first embodiment includes the following two printing units, namely, the first printing unit 4-1 capable of discharging ordinary ink and the second printing unit 4-2 capable of discharging ultraviolet curable ink, and printing can be performed selecting either of the printing units, hence selective use of expensive ink and low-cost ink can be easily realized, thereby enabling a reduction in printing costs, and, moreover, selective use of inks is enabled without large maintenance work. In addition, since a configuration is adopted comprising only one print head control device 5-2 for selecting the printing unit to be controlled, the number of print head control units can be suppressed, whereby installation costs and installation space can be suppressed.

[Second Embodiment]

Figure 3:
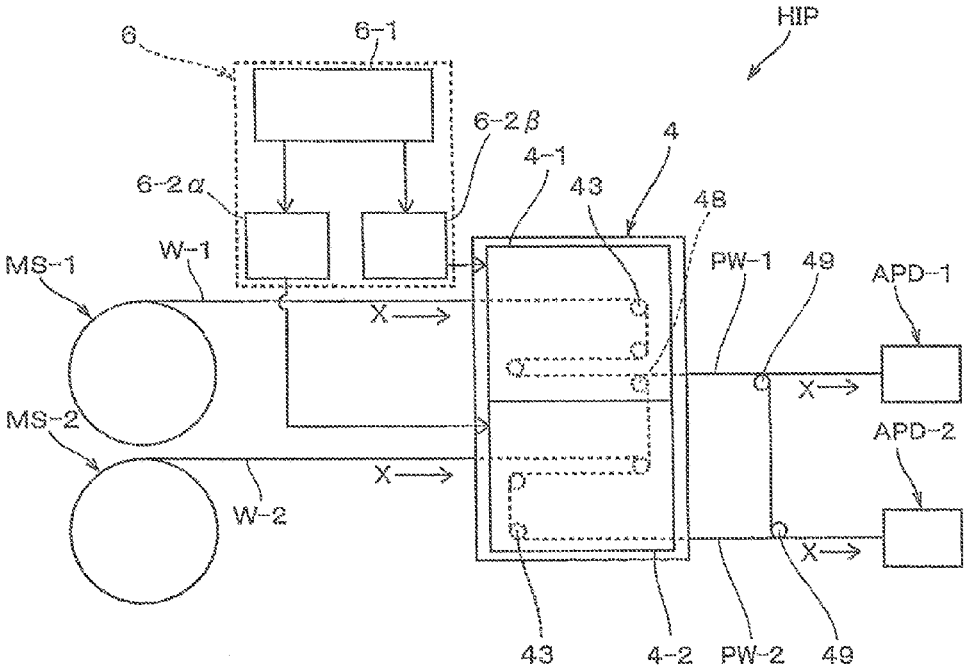
FIG. 3 is a schematic view showing an overall configuration of a hybrid ink jet printer according to a second embodiment.

FIG. 3 herein is a schematic view showing an overall configuration of a hybrid ink jet printer according to a second embodiment. Note that in FIG. 3, the symbol X indicates a running direction of the print medium. Moreover, members that are identical or similar to members in the above-described first embodiment are denoted by identical reference numerals, and an explanation about them is sometimes not provided.

As shown in FIG. 3, the hybrid ink jet printer HIP according to the second embodiment comprises two print medium supply units MS-1 and MS-2. Installed on a downstream side of the print medium supply units MS-1 and MS-2 are: a printing unit 4 for printing on a continuous paper W-1 and a continuous paper W-2; a control unit 6 for performing overall control of the hybrid ink jet printer HIP, transmission/receipt of printing information, and so on; and post-processing units APD-1 and APD-2 for performing post-processing such as cutting or folding of continuous papers PW-1 and PW-2 that have under gone printing.

The print medium supply units MS-1 and MS-2 each suspend a paper web, and supply the continuous papers W-1 and W-2 toward the printing unit 4 which is on the downstream side from the print medium supply units MS-1 and MS-2. The continuous paper W-1 is supplied to a first printing unit 4-1 and the continuous paper W-2 is supplied to a second printing unit 4-2. Note that in the second embodiment, there is a configuration adopting a paper medium like the continuous papers W-1 and W-2 as a print medium, but there may also be a configuration adopting a resin medium such as an elongated resin film as the print medium. When an elongated resin film is adopted as the print medium, a delivery device (winding-out device) for supplying the film to the printing unit 4 need only be provided.

The printing unit 4 according to the second embodiment, comprises two different kinds of printing units, namely, the first printing unit 4-1 and the second printing unit 4-2. The first printing unit 4-1 is a printing unit capable of discharging standard ordinary ink, and the second printing unit 4-2 is a printing unit capable of discharging ultraviolet curable ink.

The control unit 6 according to the second embodiment comprises a JOB management device 6-1 and two print head control devices 6-2α and 6-2β, and each of the print head control devices 6-2α and 6-2β is connected to the JOB management device 6-1 by wires.

The print head control device 6-2α outputs discharge conditions command information to print heads (not illustrated) included in the first printing unit 4-1 to control operation of the print heads included in the first printing unit 4-1. At the same time, the print head control device 6-2β outputs discharge conditions command information to print heads (not illustrated) included in the second printing unit 4-2 to control operation of the print heads included in the second printing unit 4-2. That is, the print heads that were selectively operated in the first embodiment are capable of being individually operated in the second embodiment. Therefore, printing can be performed simultaneously in two lines, using different inks on different print media.

Figure 4:
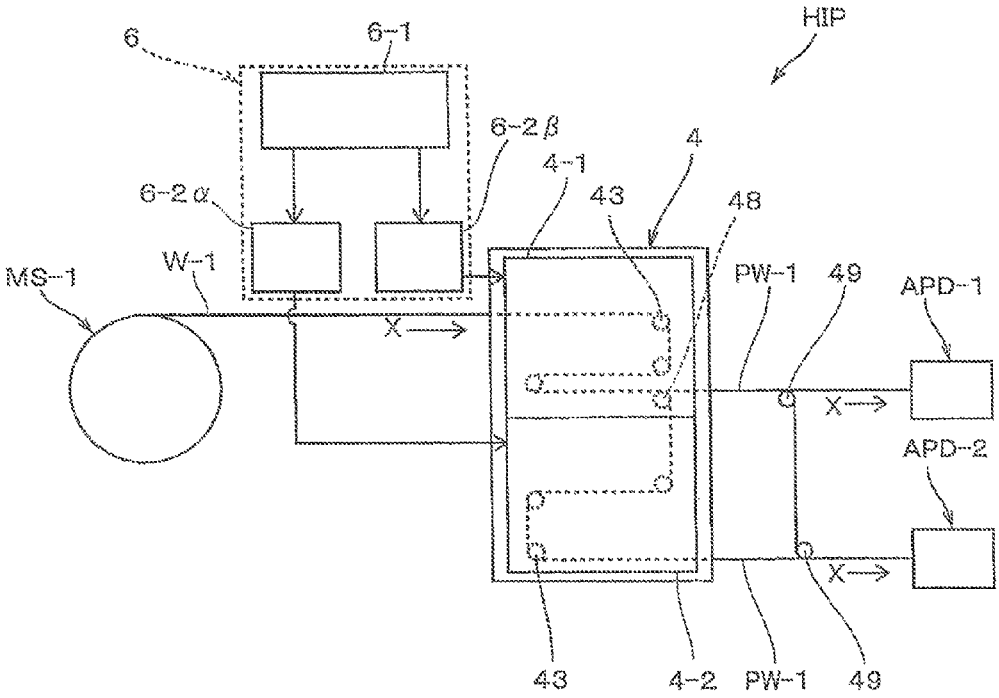
FIG. 4 is a schematic view showing the overall configuration when the print medium supplied is assumed to be one line, in the hybrid ink jet printer according to the second embodiment.

Furthermore, FIG. 4 is a schematic view showing the overall configuration when the print medium supplied is assumed to be one line, in the hybrid ink jet printer according to the second embodiment. In the above-described print medium supply units according to the second embodiment, two continuous papers, namely, the continuous paper W-1 and the continuous paper W-2 are sent forth to the printing unit 4, but, as shown in FIG. 4, a configuration supplying only the continuous paper W-1 without supplying the continuous paper W-2 may also be adopted. Moreover, when the configuration supplying only the continuous paper W-1 is adopted, it is extremely desirable to adopt a configuration having a first branching roller 48 included on an inside of the first printing unit 4-1.

The first branching roller 48 is a roller that enables branching into: a printing process where the continuous paper W-1, after passing two both-side four colors' worth of print head units included in the first printing unit 4-1 (refer to FIG. 2), is conveyed toward the post-process unit APD-1; and a printing process where the continuous paper W-1, after passing the two both-side four colors' worth of print head units included in the first printing unit 4-1, is delivered to the second printing unit 4-2. Configuring in this way enables three kinds of printing methods to be selected when printing on the continuous paper W-1.

A first printing method is a printing method where the continuous paper W-1, after being printed on using only the first printing unit 4-1, is conveyed to the post-processing unit APD-1. The second printing method is a printing method where the continuous paper W-1, after being caused to pass through the first printing unit 4-1 unchanged without being printed on, is delivered to the second printing unit 4-2 by the first branching roller 48, and is then printed on using only the second printing unit 4-2 to be conveyed to the post-processing unit APD-2. A third printing method is a printing method where the continuous paper W-1, after a portion of it is printed on in the first printing unit 4-1, is delivered to the second printing unit 4-2 by the first branching roller 48, has a further portion of it printed on using the second printing unit 4-2, and is then conveyed to the post-processing unit APD-2.

That is, the hybrid ink jet printer HIP, as well as being able to print by a printing method where printing is performed using only one of the first printing unit 4-1 and the second printing unit 4-2, is capable also of printing on one printing surface of the continuous paper W-1 using the first printing unit 4-1 and on the other surface using the second printing unit 4-2. In addition the hybrid ink jet printer HIP is capable of printing where a portion of the continuous paper W-1 is printed on using the first printing unit 4-1 and another portion is printed on using the second printing unit 4-2. Printing becomes possible without any difficulty, even when printing is performed on a special print medium such as one in which portions that are surface processed and portions that are not surface processed are mixed. Furthermore, the hybrid ink jet printer HIP also enables a printing method such as where only a photograph portion desired to be beautifully portrayed is printed by one of the printing units and a remaining character portion is printed by the other of the printing units. That is, the hybrid ink jet printer HIP is capable of economical and efficient printing that gives consideration to printing object and application.

The post-processing units according to the second embodiment comprise the two post-processing units APD-1 and APD-2. In each of the post-processing units APD-1 and APD-2, cutting processing or signature production processing are performed. Moreover, if the print medium supplied from the print medium supply units is a resin medium such as a film, rather than a paper medium such as the continuous paper, then post-processing by the roll-to-roll system is performed.

Additionally in the second embodiment, second branching rollers 49 are included between the printing unit 4 and the post-processing units APD-1 and APD-2, The second branching rollers 49 are rollers that enable branching into; a printing process where post-processing of post-printing continuous paper sent forth from the first printing unit 4-1 to a post-processing unit APD-1 side is performed in the post-processing unit APD-1; and a printing process where post-processing of post-printing continuous paper sent forth from the first printing unit 4-1 to the post-processing unit APD-1 side is performed in the post-processing unit APD-2. That is, the second branching rollers 49 enable continuous papers PW-1 and PW-2 that have undergone print processing in different printing units to be in made into one signature. Therefore, the post-processing unit APD-1 performs cutting processing or signature production processing of the continuous paper PW-1 that has undergone both-side four-color printing by ordinary ink in the first printing unit 4-1. On the other hand, the post-processing unit APD-2 performs: cutting processing of the continuous paper PW-2 that has undergone both-side four-color printing by ultraviolet curable ink in the second printing unit 4-2 or the continuous paper PW-2 that has undergone both-side four-color printing by ordinary ink and ultraviolet curable ink in the first printing unit 4-1 and the second printing unit 4-2; signature production processing where the continuous paper PW-2 is used to make one signature; or signature production processing where the continuous paper PW-1 and the continuous paper PW-2 are used to make one signature. This results in the hybrid ink jet printer HIP according to the second embodiment being capable of processing where separate print media printed by selectively using expensive ink and low-cost ink are made into one signature, thereby enabling more efficient signature production processing.

That concludes description of a specific configuration and a method of operation of the hybrid ink jet printer HIP according to the second embodiment. That is, the hybrid ink jet printer HIP according to the second embodiment comprises the two print head control devices 6-2α and 6-2β, hence different printing units can be operated separately, thereby enabling a plurality of different print media to be printed on simultaneously in two lines. In addition, the hybrid ink jet printer HIP according to the second embodiment comprises the first branching roller 48 on the inside of the first printing unit 4-1 and can print using either or both of the first printing unit 4-1 and the second printing unit 4-2, hence is capable of economical and efficient printing that gives consideration to printing object and application. Moreover, the hybrid ink jet printer HIP according to the second embodiment comprises, between the printing unit 4 and the post-processing units, the second branching rollers 49 capable of branching the print medium sent forth from the first printing unit 4-1 to a post-processing unit APD-2 side, hence processing where the post-printing continuous paper PW-1 that has come from the first printing unit 4-1 and the post-printing continuous paper PW-2 that has come from the second printing unit 4-2 are used to make one signature is enabled, thereby enabling more efficient signature production processing.

Preferred embodiments of the present invention have thus been described, but the technical scope of the present invention is not limited to the scope of description in the above embodiments. Various changes or improvements can be made to the above embodiments.

Figure 5:
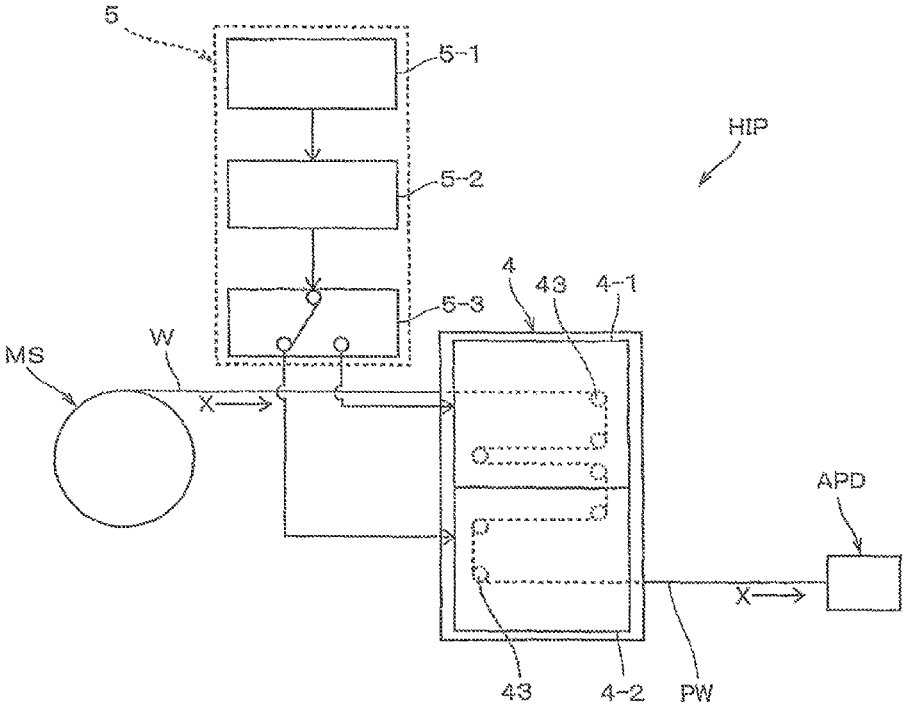
FIG. 5 is a schematic view showing a modified example of the hybrid ink jet printer according to the first embodiment.
Figure 6:
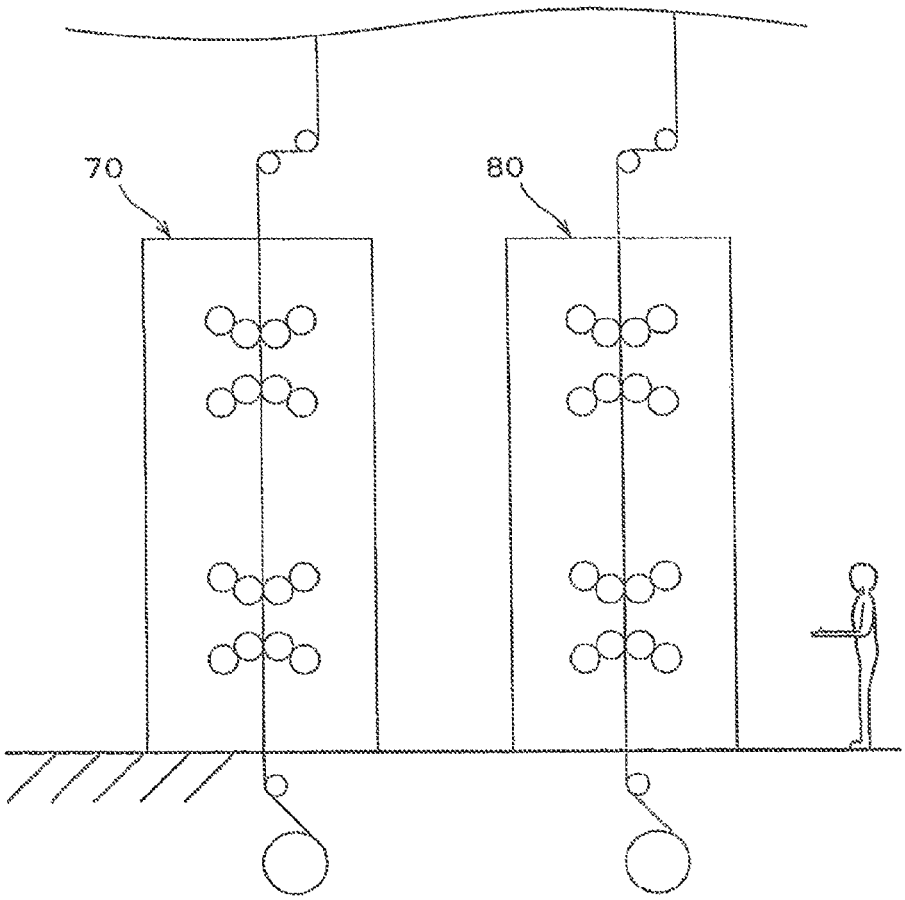
FIG. 6 is a schematic view of when one each of an offset rotary press supplying ordinary ink and an offset rotary press supplying ultraviolet curable ink are respectively installed (note that the human figure shown in the drawing is depicted to give a rough guide of device scale).
Figure 7:
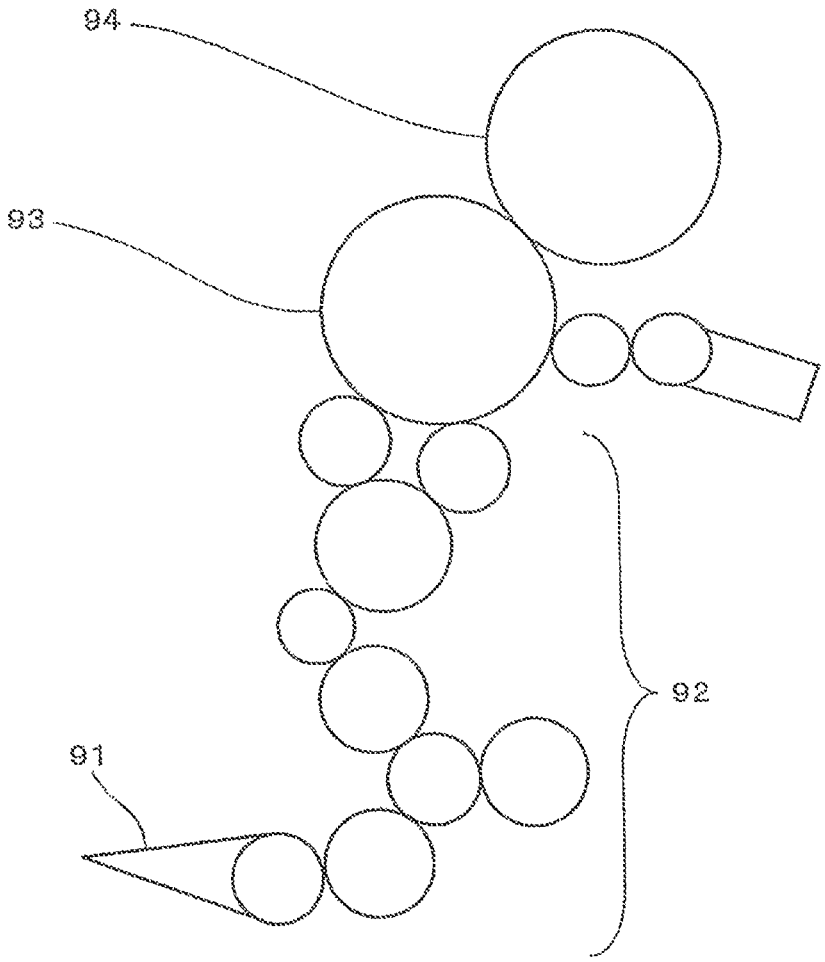
FIG. 7 is a schematic view showing the arrangement of rollers that are put in a route a long which ink is transferred in a printing unit of a conventional offset rotary press.

For example, FIG. 5 is a schematic view showing a modified example of the hybrid ink jet printer according to the above-described first embodiment. The printing unit 4 according to the above-described first embodiment illustrates a configuration when the first printing unit 4-1 and the second printing unit 4-2 are disposed in series in a lateral direction, but a plurality of printing units may also be disposed in parallel in a longitudinal direction. Moreover, all kinds of placement configurations such as a combination of series placement and parallel placement may be adopted for the plurality of printing units according to the present invention. As a result, installation space can be flexibly secured, hence a highly adaptable hybrid ink jet printer can be configured.

In addition, the print medium supply units MS, MS-1, and MS-2 or the post-processing units APD, APD-1, and APD-2 shown in the above-described first and second embodiments also merely indicated one example adoptable by the present embodiment, and all kinds of configurations may be adopted. For example, the number and arrangement format of the print medium supply units MS, MS-1, and MS-2 or the post-processing units APD, APD-1, and APD-2 may be changed arbitrarily.

Moreover, the control units 5 and 6 according to the above-described embodiments merely indicated one example adoptable by the present invention, and all kinds of configurations may be adopted provided that similar operational advantages are displayed. For example, the control units of the present invention are also capable of performing control of the hybrid ink jet printer HIP from a remote location by connecting them via an internet line, and need not be installed adjacent to the printing unit 4.

In addition, one of the two printing units in the first embodiment and the second embodiment is configured as a printing unit comprising ultraviolet curable ink, but a printing unit comprising ultraviolet curable ink is not an indispensable configurative element of the present invention. In other words, a configuration where one of the printing units comprises a cold set ink and another of the printing units comprises a heat set ink may be adopted, whereby user-matched design of the hybrid ink jet printer is possible.

Moreover, the first embodiment and the second embodiment are configured comprising two printing units, but a configuration further increasing the number of printing units may be adopted. This enables a further plurality of different inks to be employed, whereby a printer capable of printing en an even wider variety of print media without requiring large maintenance can be configured.

It is clear from the descriptions in the claims that embodiments including such changes or improvements can be included in the technical scope of the present invention.

What is claimed is:

1. A hybrid ink jet printer including:

a print medium supply unit for supplying a continuously linked print medium; and a printing unit for printing on the print medium, the printing unit comprising a first printing unit and a second printing unit, the first printing, unit including two print head units which each have print heads that discharges an ink other than ultraviolet curable ink, one of the print head units of the first printing unit being disposed capable of printing on one printing surface of the print medium, and the other of the print head units of the first printing unit being disposed capable of printing on the other printing surface of the print medium, the second printing unit including two print head units which each have print heads and an ultraviolet exposure unit, the print heads of the print head units of the second printing unit configured to discharge ultraviolet curable ink, the ultraviolet exposure unit installed on a downstream of the print heads of the print head unit of the second printing unit, one of the print head units of the second printing unit being disposed capable of printing on one printing surface of the print medium, and the other of the print head units of the second printing unit being dispose capable of printing on the other printing surface of the print medium, a drying format differing between the ink other than ultraviolet curable ink and the ultraviolet curable ink.

2. The hybrid ink jet printer according to claim 1, wherein the first printing unit and the second printing unit are disposed adjacently and are capable of delivering the print medium between first and second printing units.

3. The hybrid ink jet printer according to claim 1, wherein the first printing unit and the second printing unit are disposed in series with respect to the running direction of the print medium.

4. The hybrid ink jet printer according claim 1, wherein the print medium supply unit is a first print medium supply unit, further comprising a second print medium supply unit, wherein the first printing unit and the second printing unit are disposed in parallel with respect to the running direction of the print medium.

5. The hybrid ink jet printer according to claim 1 or 2, comprising:

a control device for providing an instruction that causes either of the first printing unit and the second printing unit to perform printing, wherein printing is performed using only either the first printing unit or the second printing unit.

6. The hybrid ink jet printer according to claim 1 or 2, comprising:

a control device for providing an instruction that causes each of the first printing unit and the second printing unit to perform printing, wherein printing is performed using each of the first printing unit and the second printing unit.

7. The hybrid ink jet printer according to claim 6, wherein performing printing on the print medium by the first printing unit and then performing further printing on the print medium by the second printing unit enables one printed matter printed by inks of different drying formats to be produced.

8. A method of hybrid ink jet printing executed using a hybrid ink jet printer, the hybrid ink jet printer including:

a print medium supply unit for supplying a continuously linked print medium; and a printing unit for printing on the print medium, the printing unit comprising a first printing unit and a second printing unit, the first printing unit including two print head units which each have print heads that discharges an ink other than ultraviolet curable ink, one of the print head units of the first printing unit being disposed capable of printing on one printing surface of the print medium, and the other of the print head units of the first printing unit being disposed capable of printing on the other printing surface of the print medium, and the second printing unit including two print heads unit which each have print heads and an ultraviolet exposure unit, the print heads of the print head units of the second printing unit configured to discharge ultraviolet curable ink, and the ultraviolet exposure unit installed on a downstream of the print heads of the print head unit of the second printing unit, one of the print head units of the second printing unit being disposed capable of printing on one printing surface of the print medium, and the other of the print head units of the second printing unit being disposed capable of printing on the other printing surface of the print medium, the method comprising:

printing being executed by causing a drying format to differ between the ink other than ultraviolet curable ink and the ultraviolet curable ink.

* * * * *